US006681670B2

(12) United States Patent
Caspar et al.

(10) Patent No.: US 6,681,670 B2
(45) Date of Patent: Jan. 27, 2004

(54) WATER JET EDGE CUTTER WITH INTEGRAL TRIM CHUTE

(75) Inventors: Roman C. Caspar, Beaconsfield (CA); Dieter H. Hilker, Mascouche Heights (CA)

(73) Assignee: Paprima Industries Inc., Montreal (CA)

( * ) Notice: Subject to any disclaimer, the term of this patent is extended or adjusted under 35 U.S.C. 154(b) by 33 days.

(21) Appl. No.: 10/083,524

(22) Filed: Feb. 27, 2002

(65) Prior Publication Data

US 2002/0124701 A1 Sep. 12, 2002

(30) Foreign Application Priority Data

Mar. 7, 2001 (CA) ..... 2339453
Jan. 31, 2002 (CA) ..... 2370242

(51) Int. Cl.[7] ..... B26F 3/00; D06H 7/00

(52) U.S. Cl. ..... 83/177; 83/402; 83/428; 162/195

(58) Field of Search ..... 83/53, 177, 402, 83/428, 917, 98, 100; 162/286, 310, 363, 195; 51/410, 424, 321, 439

(56) References Cited

U.S. PATENT DOCUMENTS

| | | | | |
|---|---|---|---|---|
| 2,003,404 A | | 6/1935 | Valentine | 164/65 |
| 3,234,836 A | | 2/1966 | Buff | 83/422 |
| 3,252,366 A | | 5/1966 | Karr | 83/98 |
| 3,495,492 A | | 2/1970 | Gerber et al. | 83/374 |
| 3,835,747 A | | 9/1974 | Bystron | 83/422 |
| 3,877,334 A | * | 4/1975 | Gerber | 83/22 |
| 3,996,825 A | | 12/1976 | Terry | 83/53 |
| 4,009,626 A | | 3/1977 | Gressman | 83/116 |
| 4,137,804 A | * | 2/1979 | Gerber et al. | 83/177 |
| 4,231,272 A | | 11/1980 | Crouse | 83/98 |
| 4,242,934 A | | 1/1981 | Coburn | 83/100 |

(List continued on next page.)

FOREIGN PATENT DOCUMENTS

| | | | |
|---|---|---|---|
| CA | 2031802 | 11/1989 | B26F/1/26 |
| EP | 0 737 553 A | 10/1996 | |
| EP | 0 870 583 A | 10/1998 | |
| FR | 2 647 049 | 5/1989 | B26F/1/26 |

*Primary Examiner*—Allan N. Shoap
*Assistant Examiner*—Ghassem Alie

(57) ABSTRACT

A movable water jet edge trimmer has an integral trim chute attached to a cutting support plate for the trimmer. The support plate has a cutting aperture and a series of suction apertures located inboard of the outside edge of the travelling web for supporting the web against the support plate as a water jet passes out through the cutting aperture away from the support plate and through the web. The support plate has a curved surface located downstream and outboard of the cutting aperture which curves into a trim chute opening of a trim chute. Negative pressure is applied from the trim chute to the trim chute opening to draw any strip of material cut from the edge of the web over the curved surface and into the trim chute. The trim chute opening has a first edge that extends substantially parallel to the direction of the travel of the web and is substantially aligned and slightly inboard of the cutting aperture whereby the trim chute passes into the trim chute opening and a small portion of the edge of the web passes over the opening in the trim chute. In applications where the web comprises a paper of a lighter basis weight, an additional second support plate is utilized spaced from the first support plate on the opposite side of the web from the first support plate so as to sandwich the web between the two support plates.

11 Claims, 5 Drawing Sheets

U.S. PATENT DOCUMENTS 4,312,254 A 1/1982 Pearl ..... 83/177
4,329,893 A 5/1982 Wong ..... 83/24
4,410,315 A 10/1983 Frye ..... 493/342
4,476,756 A 10/1984 Pearl et al. ..... 83/422
4,476,758 A * 10/1984 Coburn ..... 83/479
4,484,500 A 11/1984 Reba et al. ..... 83/98
4,501,182 A 2/1985 Jardat et al. ..... 83/177
4,527,346 A 7/1985 Schwartzott ..... 38/144
4,567,796 A * 2/1986 Kloehn et al. ..... 83/53
4,702,664 A 10/1987 Lukens, Jr. ..... 414/676
4,708,275 A 11/1987 Farrell ..... 226/97
4,827,679 A * 5/1989 Earle, III ..... 451/40
5,496,431 A 3/1996 Hirakawa et al. ..... 156/269
5,571,381 A * 11/1996 Vessari et al. ..... 162/195
5,636,558 A * 6/1997 Sanders et al. ..... 83/53
5,699,707 A 12/1997 Campbell, Jr. ..... 83/100
5,836,224 A * 11/1998 Gerber ..... 83/22
5,852,963 A 12/1998 Koponen et al. ..... 83/53
6,001,219 A * 12/1999 Caspar ..... 162/286
6,021,699 A 2/2000 Caspar
6,327,948 B1 * 12/2001 Tuori ..... 83/53

* cited by examiner

WATER JET EDGE CUTTER WITH INTEGRAL TRIM CHUTE

FIELD OF THE INVENTION

The present invention relates to a water jet web edge trimmer having a trim chute integral and moveable therewith for cutting a leader strip and new edge into a travelling web and disposing of the strip into the trim chute.

BACKGROUND OF THE INVENTION

In the papermaking industry, knives or water jets are commonly employed to cut through the traveling web or sheet. The knives and water jets are used in edge trimming, slicing, cross-cutting, and tail cutting applications within the papermaking machine. However, when the knives or water jet cutters are used in an edge trimming application, trim chutes or bins are located downstream from the cutter of the strip of web material trimmed from the main portion of the web.

Typically, a trim chute relies on some form of negative pressure to draw the trim strip into the chute. The higher the machine speed and further the trim chute is located from the edge trimming or cutting point, the more the risk of having the trim either not follow a normal path into the trim chute or the more the requirement for corrective forces to draw or guide the strip into the trim chute.

Water jet cutters currently in use typically cut through a web passing over a web support plate or table. The location of the trim chute is downstream and separated from the water jet cutting device. This results in the trim chute having to be located under the path of the travelling web downstream of the web including that portion of the web that remains on the edge of the web as the new edge of the web is cut into the web. This is also true for the water jet cutting head disclosed in U.S. Pat. No. 6,021,699 issued Feb. 8, 2000 to Roman Caspar. In this patent a water jet cutting head is disclosed that is capable of supporting the web while at the same time cutting a leader and new edge in the travelling web; however, there is no disclosure in this patent with respect to the disposal of the trimmed strip from the web and this patent does not contemplate the disposal of the trimmed strip.

SUMMARY OF THE INVENTION

The present invention relates to the use of a moveable integral water jet cutting and trim chute unit that is adapted for relative movement inwardly of the outside edge of the web. The trim chute has an opening exposed to the new edge of the cut web that does not exert undo suction or guide pressures on the remaining web portion at all times during the cutting operation. This is accomplished by having a support plate with a water jet cutting aperture located therein and from which the trim chute is integrally supported extending out of and away from the plane of the web. In particular, the cutting aperture in the support plate is substantially aligned, and preferably located slightly inboard of, an inside or first edge defining the trim chute opening. As a result, the strip trimmed from the edge of the web is outboard of the cutting aperture and the remainder of the web is located, for the most part, inboard of this cutting aperture. Since the aligned edge of the trim chute is located either in line or slightly inboard of the cutting aperture, a restricted amount of negative pressure is applied from the opening of the trim chute to an edge of the remaining web portion. Thus a majority of this negative pressure acts to draw the strip into the trim chute. By having the support plate and the trim chute integrally connected, both the water jet cutter and the trim chute move in unison into the edge of the web maintaining the cutting aperture and the aligned first edge of the trim chute in a fixed position to each other. Further the distance the trim strip travels to the trim chute is relatively short.

In accordance with the preferred aspect of the present invention, the support plate further includes a plurality of suction apertures. The suction apertures are positioned substantially on an inboard side of a cutting aperture defined relative to the web to support the web after the trim strip has been cut and to permit the trim strip to be directed into the trim chute. The water jet nozzle is positioned on the side of the support plate opposite to the web (behind the support plate) in alignment with the cutting aperture to direct a water jet through the cutting aperture. The jet passes through the support plate and cuts through the web. Suction is applied to the support plate at the section apertures to draw the web portion on the inboard side of the cutting aperture into engagement with the support plate while permitting the remainder of the trimmed strip to pass into the trim chute.

The trim chute is integrally attached to the support plate preferably on the same side of the web plate as the support plate. The trim chute has a lead in curved surface immediately downstream of the cutting aperture that extends from the support plate and into the trim chute opening so as to provide a continuous path over which the strip passes. In an alternative embodiment, the trim chute extends out of the plane of the web on the opposite side of the web as the support plate. In this alternative embodiment, a continuous path of travel for the trimmed strip is provided between the support plate and the trim chute opening by the trim chute and support plate having overlapping flanges on opposite sides of the plane of the web which are interconnected by an outside edge flange member located outboard of the web and transversing the plane of the web. The overlapping flanges on opposite sides of the plane of the web effect the transfer from one flange associated with the support plate to the flange associated with the trim chute.

Since the trim chute is adapted to move relative to the web in unison with the support plate of the water jet cutter, a negative pressure is applied to the trim chute by a laterally moveable connection between two trim chute funnels whereby one funnel moves relative to the other stationary funnel and the moving funnel has an opening larger than the stationary funnel, or visa versa. Alternatively, a flexible hose maybe connected to the movable trim chute.

In applications where the web comprises a paper of a lighter basis weight, such as, for example, tissue or magazine paper, an additional second support plate is utilized. This second support plate is spaced from the first support plate on the opposite side of the web from the first support plate so as to sandwich the web between the two support plates as the cutting unit moves in from the edge of the web and continues to cut a trim strip from the web.

To effect simultaneous movement of the first and second support plates relative to the web, a movable carriage is provided for supporting first and second arm assemblies respectively on first and second opposing sides of the travelling web. The first arm assembly comprises the first support plate, the water jet nozzle, and the trim chute. The second arm assembly comprises the second support plate.

The second support plate has an opening aligned with the nozzle to permit effluent spray to pass. Preferably, the first and second support plates have leading curved edges to guide the web between the first and second support plates as the first and second arm assemblies are moved inwardly of the outside edge of the web.

It is also contemplated that the second arm assembly may further comprise a waste disposal post positioned and spaced from the second opposing side of the web aligned with the water jet nozzle to receive effluent spray from the nozzle after it cuts through the web.

In accordance with one aspect of the present invention, there is provided a movable integral water jet web cutting and trim chute unit adapted for relative movement inwardly of an outside edge of a web travelling in a first direction to cut a strip from the travelling web and to dispose of the strip. The moveable integral water jet web cutting and trim chute unit comprises a support plate adapted to extend relative to the plane of the travelling web to support the web immediately prior to and after the strip is cut from the edge of the travelling web as the unit moves relative to the web. The support plate has a cutting aperture. The unit comprises a water jet nozzle positioned behind the support plate in alignment with the cutting aperture for directing a water jet through the cutting aperture and away from the support plate to cut through the web and form the strip. The unit has a trim chute extending out of and away from the plane of the travelling web from the support plate. The trim chute has an opening in the support plate downstream of the cutting aperture. The trim chute opening is bounded by a first side edge extending in the first direction of web travel substantially in alignment with the cutting aperture to limit that portion of the web passing over the trim chute opening. The unit has negative pressure means associated with the trim chute for drawing the strip into and through the trim chute.

In accordance with another aspect of the present invention there is provided a moveable integral water jet web cutting and trim chute unit adapted for relative movement inwardly of an outside edge of a web travelling in a first direction to cut a strip from the travelling web and to dispose of the strip. The moveable web cutting and trim chute unit comprises a support plate adapted to extend relative to the travelling web to support the web immediately prior to and after the strip is cut from the outside edge of the travelling web as the web cutting and trim chute unit moves inwardly relative to the web. The support plate has a cutting aperture and a plurality of suction apertures. The suction apertures are positioned substantially on an inboard side of the cutting aperture defined relative to the web to support the web after the strip has been cut and to permit the strip to be directed into the trim chute. The unit has first negative pressure means associated with the suction apertures of the support plate for drawing the travelling web into engagement with the support plate adjacent the cutting aperture as the web passes over the support plate. The unit has a water jet nozzle positioned behind the support plate in alignment with the cutting aperture for directing a water jet through the cutting aperture and away from the support plate to cut through the web to form a new edge in the web and to form the strip. The unit has a trim chute extending from the support plate out of and away from the plane of the travelling web and located on the same side of the web as the support plate. The trim chute has an opening in the support plate downstream of the cutting aperture into which the strip passes. The unit has second negative pressure means associated with the trim chute for drawing the strip into the trim chute opening.

In accordance with still yet another aspect of the invention there is provided a moveable integral water jet web cutting and trim chute unit having an alternative embodiment for the trim chute wherein the trim chute extends out of and away from the plane of the travelling web and is located on the opposite side of the web as the support plate. The support plate has an outside edge flange member located outboard of the web and traversing the plane of the web to support the trim chute relative to the support plate. The trim chute and the support plate have overlapping flanges on opposite sides of the plane of the web to transfer the strip from the support plate flange to the trim chute flange. The trim chute has an opening downstream of the cutting aperture into which the strip passes.

In accordance with still yet another aspect of the present invention there is provided a moveable integral water jet web cutting and trim chute assembly adapted for relative movement inwardly of an outside edge of a web travelling in a first direction to cut a strip from the travelling web and to remove the strip. The moveable integral water jet web cutting and trim chute assembly comprises a movable carriage supporting first and second arm assemblies respectively on first and second opposing sides of the travelling web to move the first and second arm assemblies inwardly of the outside edge of the web. The first arm assembly comprises a first support plate, a water jet nozzle, and a trim chute. The first support plate is adapted to extend relative to the plane of the travelling web to support the web on its first side immediately prior to and after the strip is cut from the edge of the travelling web as the first and second arm assemblies move relative to the web. The first support plate has a cutting aperture. The water jet nozzle is positioned behind the first support plate aligned with the cutting aperture for directing a water jet through the cutting aperture and away from the support plate to cut through the web and form the strip. The trim chute extends out of and away from the plane of the travelling web from the support plate and has an opening in the support plate downstream of the cutting aperture. The second arm assembly comprises a second support plate adapted to extend relative to the plane of the travelling web and to be spaced from the first support plate for supporting the web on its second side immediately prior to the strip being cut from the edge of the travelling web as the first and second arm assemblies move relative to the web.

BRIEF DESCRIPTION OF THE DRAWINGS

For a better understanding of the nature and objects of the present invention reference may be had to the accompanying diagrammatic drawings in which.

DETAILED DESCRIPTION OF THE DRAWINGS

Figure 1:
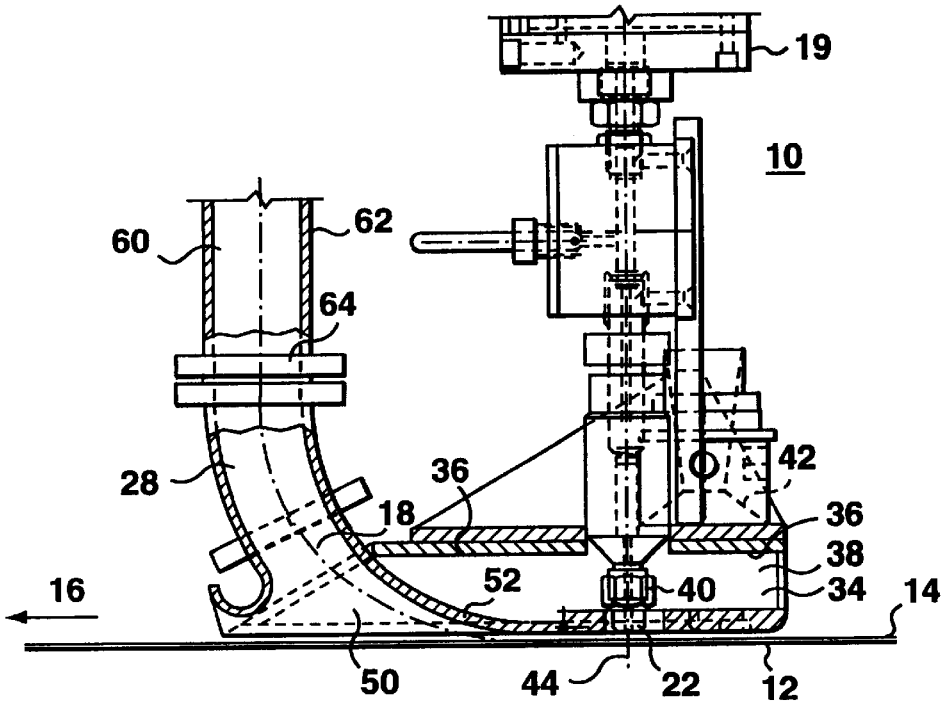
FIG. 1 is a side view of the web cutting and trim chute unit of the present invention.
Figure 2:
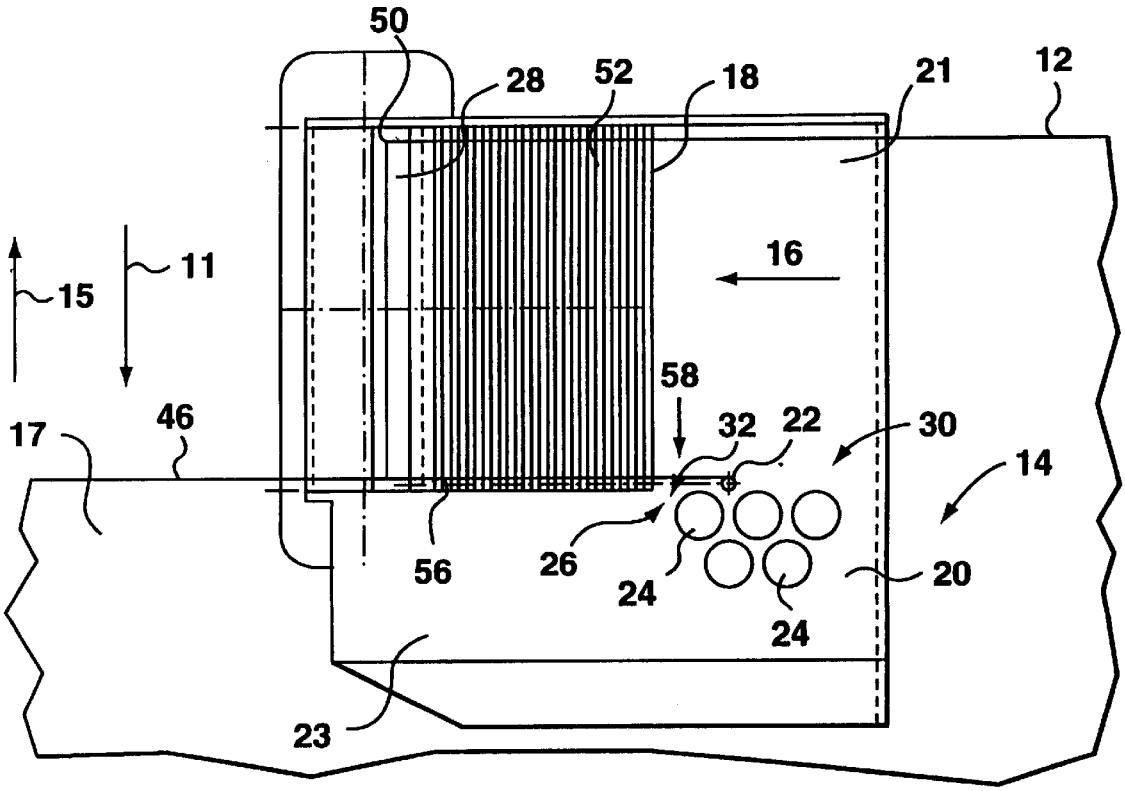
FIG. 2 is a bottom view of the web cutting and trim chute unit of the present invention.
Figure 3:
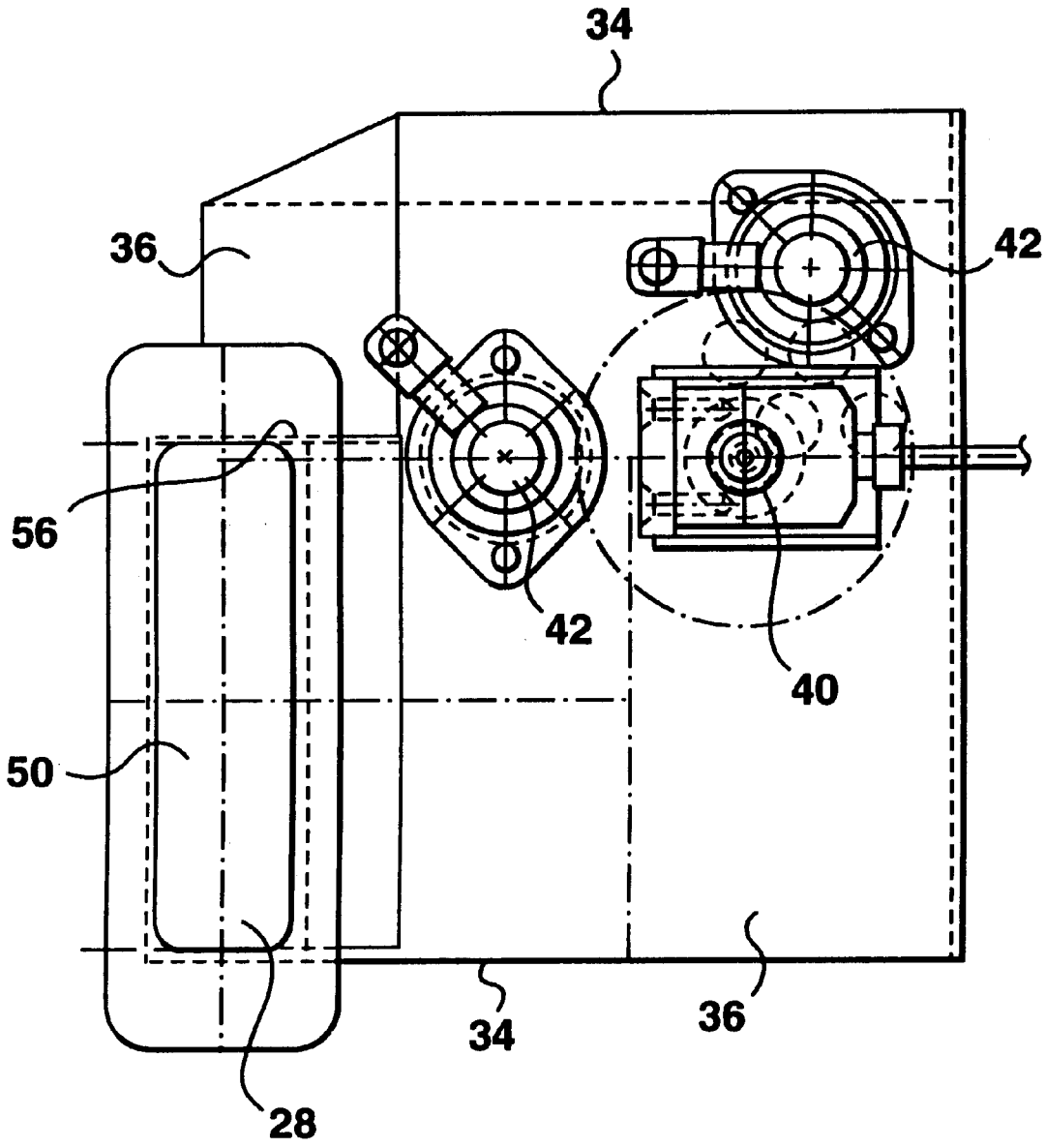
FIG. 3 is a plan view of the web cutting and trim chute unit of the present invention.

Referring now to FIGS. 1 through 3 there is shown the moveable integral water jet web cutting and trim chute unit 10 that is adapted for relative inward movement in the direction of arrow 11 (FIG. 2) from an outside surface 12 of web 14 travelling in first direction 16 (FIG. 1). It should be understood that the integral water jet web cutting and trim chute unit 10 may be attached to an overhead support arm (not shown or shown as 116 in FIG. 5) that is laterally moveable relative to the web 14 to move unit 10 in the directions of arrows 11 and 15. Alternatively, it is also possible that the web cutting and trim chute unit 10 may remain relatively stationary and that the web 14 can move inwardly or outwardly relative thereto in the direction shown by arrows 11 and 15. Hence for the purposes of the present invention the word "moveable" to describe the water jet cutting and trim chute unit 10 refers to the relative lateral movement between unit 10 and web 14 in the directions of arrows 11 and 15. For the purposes of the present invention the web 14 normally travels in the direction 16 and the web cutting and trim chute apparatus 10 preferably moves into the web from edge 12 in the direction of arrow 11. As the web cutting apparatus 10 moves into the edge 12 it cuts into the edge forming a lead in strip 18. The remainder 17 of the web 14 travels past the web cutting and trim chute apparatus 10 for further processing within the paper making or web processing apparatus.

The web cutting and trim chute unit 10 comprises a support plate 20 having a relatively flat lead in surface 21 that supports web 14 and a downstream flat surface 23 that supports an edge of the remaining web portion 17 of the web 14. The support plate 20 extends substantially parallel to the plane of the travelling web 14. While the present invention in FIG. 1 shows the web cutting apparatus being supported above the "horizontal" plane of the web 14, it should be understood that the plane of the web 14 maybe vertical or any other angle relative to the horizontal with the web cutting and trim chute apparatus 10 being located to one side of the web 14; whether above or below the web 14. The support plate 20 supports the web immediately prior to and after the strip 18 is cut from the outside of edge 12 of the travelling web 14 as the web cutting and trim chute unit 10 moves inwardly in the direction of arrow 11 relative to the web 14.

The support plate 20 has a cutting aperture 22 and a plurality of suction apertures 24. The suction apertures 24 are positioned substantially on the inboard side 26 of the cutting aperture 22 relative to the web 14. The suction apertures 24 support the web 14 against the support plate 20 immediately prior to the cutting aperture 22. The suction apertures 24 also support the edge of the remaining web portion 17 of the web 14 against support plate 20 after the trim strip 18 has been cut at cutting aperture 22. This permits the trim strip 18, un-supported by the suction apertures 24, to be directed or discarded away from the remainder portion 17 of the web 14. The suction apertures are positioned as shown both upstream 30 and downstream 32 of the cutting aperture 22 in the first direction 16 of web travel.

Referring to FIG. 1, the support plate 20 further includes depending side walls 34 extending away from the web 14 and a rear wall 36 closing the side walls 34 to define a chamber 38. A water jet nozzle 40 is located within the chamber 38, behind support plate 20 (i.e. opposite side of support plate 20 from web 14) and aligned with cutting aperture 22. The support plate further includes a first negative pressure means 42 associated with a chamber 38 so as to apply suction into or from the chamber 38 through the rear wall 36 thereby creating suction through suction apertures 24. This permits for the web to be drawn into engagement with the support plate 20 adjacent the cutting aperture 22 for a good cut through the web 14.

The water jet nozzle 40 directs a water jet 44 through the cutting aperture 22 and away from the support plate 20 to cut through the web 14 and to form a new edge 46 in the web 14 and to form strip 18.

The water jet web cutting and trim chute unit 10 further includes the trim chute 28 which is an integral part of the support plate 20. The trim chute 28 extends out of and away from the plane of the travelling web 14 and is located on the same side of the web 14 as a support plate 20 as shown in FIGS. 1, 2 and 3. The trim chute 28 has an opening 50 in the support plate 20 that extends along or parallel to the plane of the web 16 and is located downstream of the cutting aperture 22. The trim chute 28 further includes a lead in curved surface 52 located immediately downstream of the cutting aperture 22 and outboard of the cutting aperture 22. This lead in curved surface 52 extends from the support plate 20 and into the trim chute opening 50 over which the strip 18 passes. Lead-in curved surface 52 also defines a wall for chamber 34. The curved surface 52 of the trim chute 28 has a first side edge 56 extending substantially along the first direction 16 of web travel. The first side edge 56 is substantially in alignment with the cutting aperture 22 and is preferably as shown in FIG. 1 positioned slightly inboard 58 of the cutting aperture 22 relative to the web 16. This permits for a portion of the new edge 46 cut from the web 20 to slightly overlap the trim chute opening 50. However, very little negative pressure is applied to this new edge 46 and the negative pressure is used to draw the strip 18 into the opening 50 of the trim chute 28. Further, the strip 18 is cut outboard of the first side edge 56.

A second negative pressure in the form of a suction device is applied to a stationary extension chute 62 having an opening 64 coupled with the trim chute 28 that permits relative lateral movement in the direction of arrows 11 and 15 between the trim chute 28 and the stationary extension chute 62.

Figure 4:
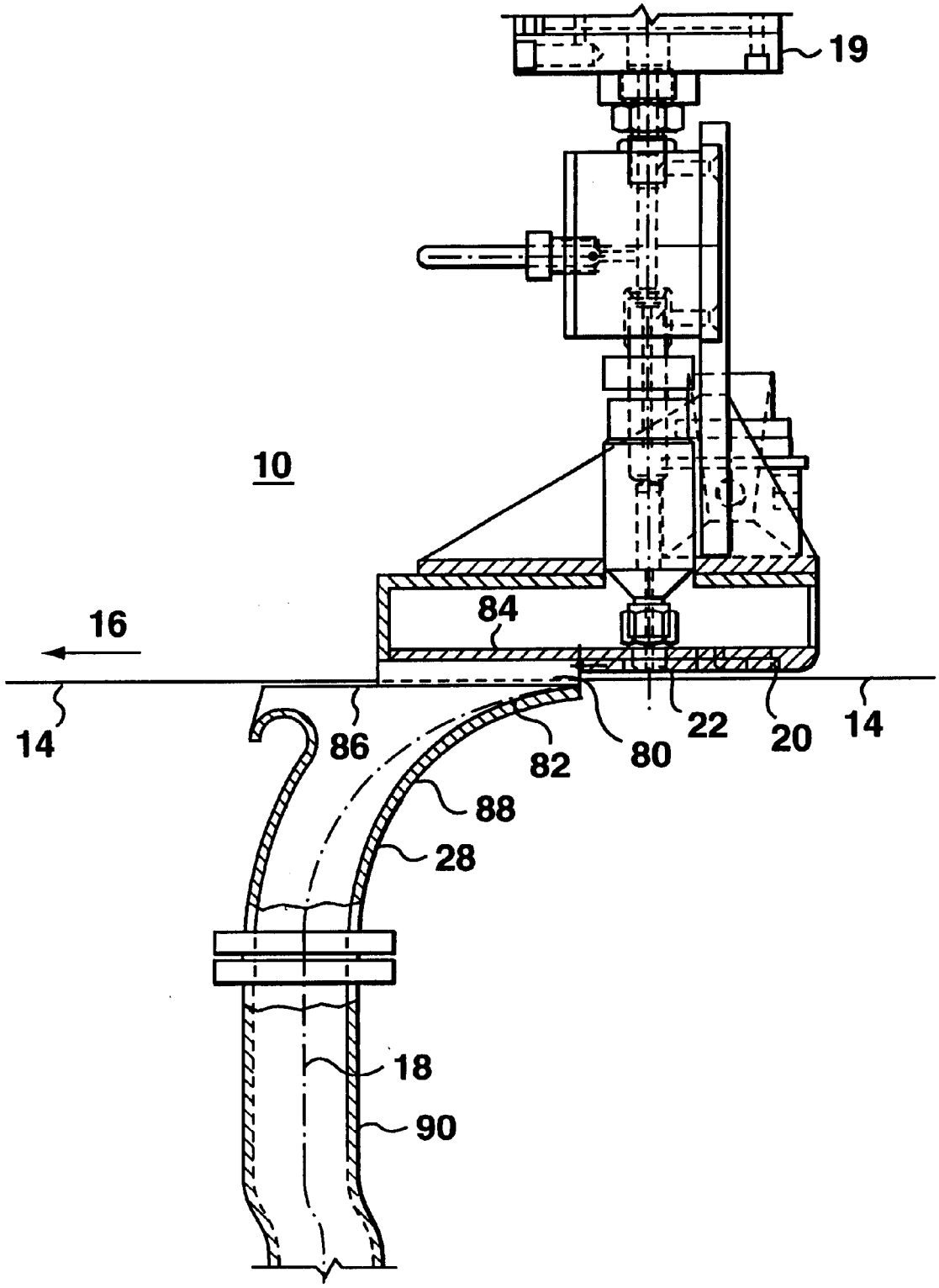
FIG. 4 is a side view of an alternative embodiment of the present invention.

Referring now to FIG. 4, an alternative embodiment is shown wherein the trim chute 28 is located extending out from the plane of the web 14 which is located on the opposite side of the web 14 from the support plate 20. In this embodiment, the support plate 20 has an outside edge flange 80 located outboard of the web 14 and traversing the plane of the web 14 so as to support the trim chute 28 relative to the support plate 20. The trim chute 28 and the support plate 20 have overlapping flanges 82, 84 respectively on opposite sides of the plane of the web 14 so as to effect a transfer of the strip 18 from the support flange 84 to the trim chute flange 82. The trim chute has an opening 86 downstream of the cutting aperture 22 and the lead in surface 88. Second negative pressure means 90 is associated with the trim chute 28 in this embodiment. In this embodiment an alternative flexible hose 92 is connected to the trim chute 28 to maintain the negative pressure in the trim chute 28 or to allow movement of the trim chute in the direction of arrows 11 and 15 laterally of the web 14.

While the preferred embodiments show the integral formation of the water jet cutting support plate 20 and the trim chute 28, it should be appreciated that the components of the unit 10 may be manufactured separately and assembled into an integral unit 10.

Figure 5:
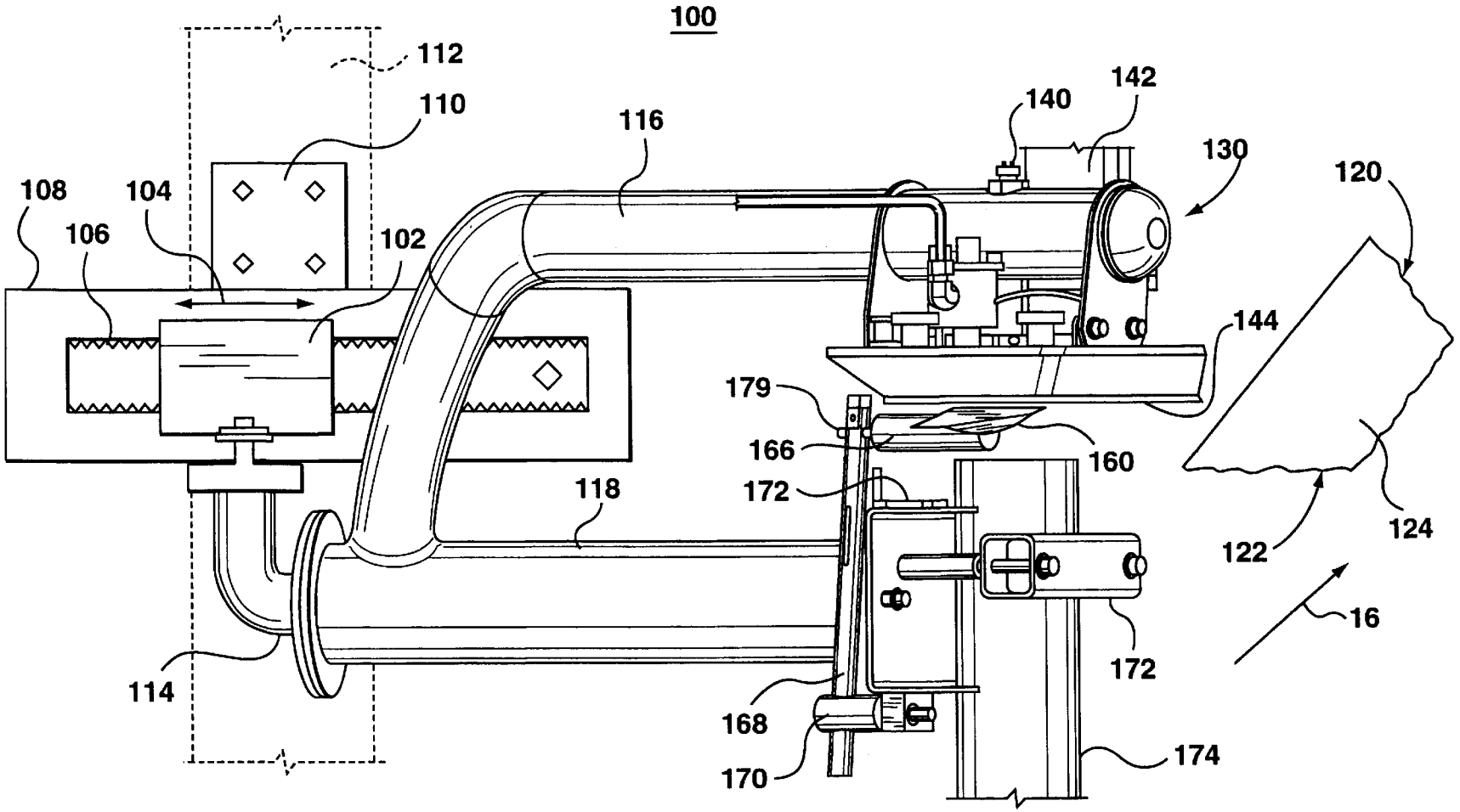
FIG. 5 is a perspective view of the web cutting and trim chute assembly of the present invention; and, FIG. 6 is an enlarged perspective view showing the first and second support plates in more detail; and, FIG. 7 is an plan view of the second lower arm assembly looking down on the second support plate.
Figure 6:
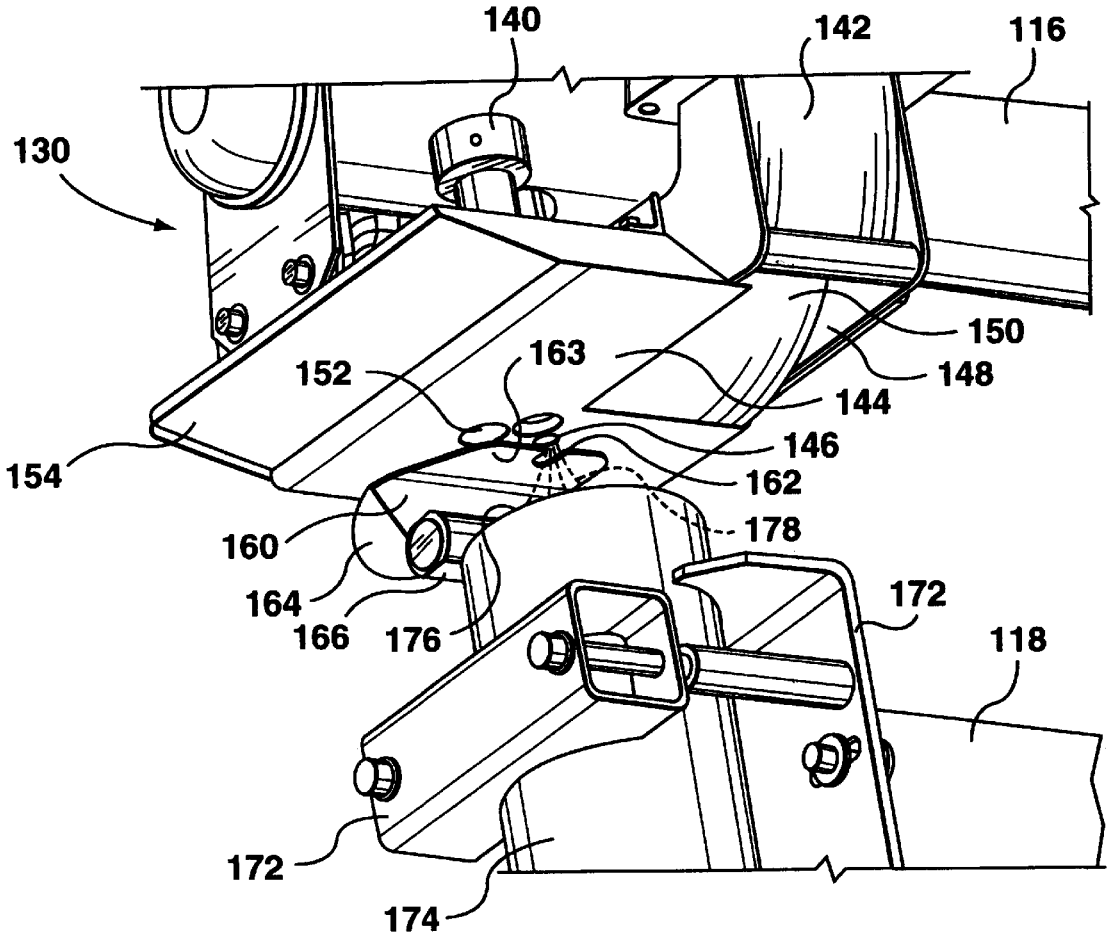
Figure 7:
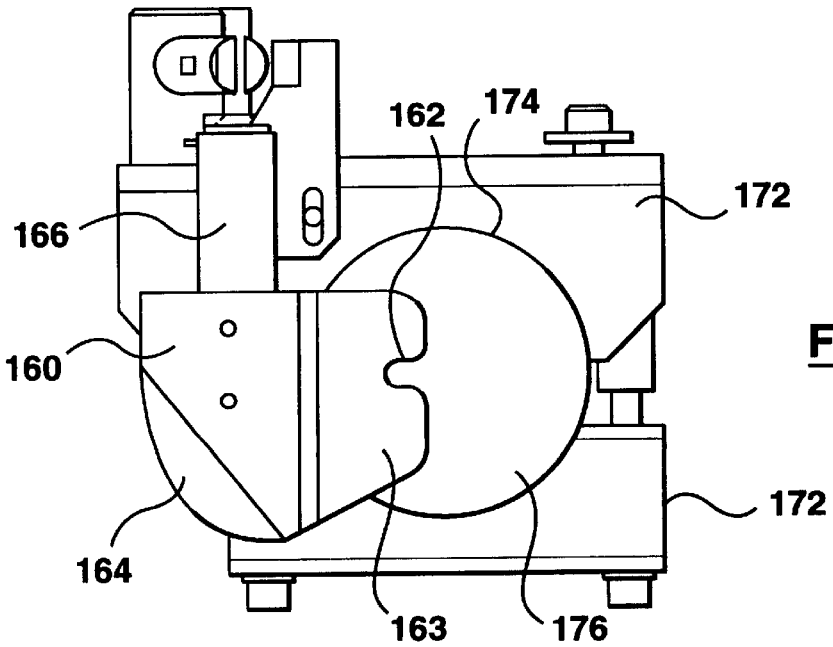

Referring now to FIGS. 5 through 7 there is shown a moveable integral water jet cutting and trim chute assembly 100. The water jet trim assembly 100 includes a carriage 102 mounted for lateral movement, as shown by arrows 104, on rails 106. It should be understood that the carriage 102 may be moved relative to the rails 106 by pneumatic means, chains and or any other mode of motive means. The guide rails 106 are mounted in housing 108 which in turn is attached by bolts at bracket 110 to beam 112.

The carriage 102 carries or supports a supporting arm 114 which branches out into a first upper support arm assembly 116 and a second lower support arm assembly 118. The moveable carriage 102 supports the first and second arm assemblies 116 and 118 respectively on opposing sides 120 and 122 of a travelling web 124. The carriage 102 moves into the edge of the web 124 so as to bring the web 124 between the first upper support assembly 116 and the second lower support assembly 118.

The first arm assembly 116 comprises an integral water jet cutting apparatus and trim chute generally shown at 130. The apparatus 130, comprises a water jet nozzle 140, a trim chute 142, and a first upper support plate 144. The first support plate 144 is adapted to extend relative to the plane of travelling web 124 on the first side 120 of web 124. The first support plate 144 has a cutting aperture 146. The water jet nozzle 140 is positioned above the cutting aperture 146 for directing a water jet through the cutting aperture 146 and away from the first upper support plate 144. The trim chute 142 extends out of and away from the plane of the travelling web 124 upwardly from the support plate 144 and has an opening 148 with a curved surface 150 which is located downstream of the cutting aperture 146. The support plate 144 further includes suction apertures 152 through which suction is provided to draw the web 124 against the upper support plate 144. The upper support plate 144 further has a chamfered or curved leading edge or wall 154. Wall 154 is adapted to move towards and into the edge of the web 124 and gently guide the web 124 over wall 154 and across the surface of support plate 144.

The second lower arm assembly 118 comprises a second support plate 160 adapted to extend relative to the plane of the travelling web and spaced from the first support plate 144. The second support plate 160 supports the web 124 on the lower or second side 122 and effectively sandwiches the web 124 between plates 144 and 160. The second support plate 160 has an opening or a cut out groove 162 in trailing surface portion 163 which is aligned with the water jet cutting aperture 146 so that the water jet passing out through aperture 146 and cutting the web 124 passes through the grooved or slotted opening 162. The second support plate 160 further includes a bent or gently curving leading surface 164 which is utilized to urge or guide the paper web 124 into a relationship between the support plate 154 and the lower support plate 160. It is further contemplated that the relationship between support plate 154 and plate 160 can be adjusted by means of a pivot or set screw 179 anchored to post 168.

The support plate 160 is held relative to a main arm of the second arm assembly 118 by a series of tubular brackets 166, 168 and 170. It should be understood that the supporting tubes 166, 168 and 170 are adjustable relative to each other so as to provide for a proper adjustment of the support plate 160 relative to the upper or first support plate 144. The tubular bracket 170 is connected to another clamp mechanism 172 which is mounted to the second arm assembly 118. The clamp assembly 118 also holds a hollow waste disposal post 174 that has opening 176 into which effluent 178 (see FIG. 6) passes as the water jet cuts through the web 124.

The use of the moveable carriage 102 together with the first and second arm assemblies 116, 118 holding the first support plate 144 and the second support plate 166 relative to each other on opposing sides of the web 124 provides an effective apparatus for allowing the cutting into the edge and edge trimming of a web 124 of paper having a relatively light basis weight. One example of such a lighter basis weight web of paper is tissue paper. In the event that heavier basis weights of paper are utilized, the suction apertures 152 in the upper support plate 144 should be sufficient to support the web 124 against support plate 144 during the cutting operation.

It should be understood that alternative embodiments of the present invention may be readily apparent to a person skilled in the art in view of the above description for the preferred embodiments of this invention. Accordingly, the scope of the present invention should not be limited to the teachings of the preferred embodiments and should be limited to the scope of the claims that follow.

What is claimed is:

1. A moveable integral water jet web cutting and trim chute assembly adapted for relative movement inwardly of an outside edge of a web travelling in a first direction to cut a strip from the travelling web and to remove the strip, the moveable integral water jet web cutting and trim chute assembly comprising:

a movable carriage supporting first and second arm assemblies respectively on first and second opposing sides of the travelling web to move the first and second arm assemblies inwardly of the outside edge of the web;

the first arm assembly comprising a first support plate, a water jet nozzle, and a trim chute, the first support plate from one opposing end to another being adapted to extend substantially parallel to the plane of the traveling web and the first support plate having a cutting aperture, the water jet nozzle being positioned behind the first support plate aligned with the cutting aperture for directing a water jet through the cutting aperture and away from the support plate to cut through the web and form the strip, the support plate supporting the web on its first side along the plate of the traveling web immediately upstream and downstream of the cutting aperture as the first and second arm assemblies move relative to the web, and the trim chute extending out of and away from the plane of the traveling web from the support plate and having an opening in the support plate downstream of the cutting aperture; and, the second arm assembly comprising a second support plate adapted to extend relative to the plane of the travelling web and to be spaced from the first support plate, for supporting the web on its second side immediately prior to the strip being cut from the edge of the travelling web as the first and second arm assemblies move relative to the web.

2. The moveable integral water jet web cutting and trim chute assembly of claim 1 wherein the second support plate has an opening aligned with the nozzle to permit effluent spray to pass.

3. The moveable integral water jet web cutting and trim chute assembly of claim 1 wherein the first and second support plates have leading curved portions to guide the web between the first and second support plates as the first and second arm assemblies are moved inwardly of the outside edge of the web.

4. The moveable integral water jet web cutting and trim chute assembly of claim 1 wherein the second arm assembly further comprises a waste disposal post the waste disposal post being positioned spaced from the second side of the web aligned with the water jet nozzle to receive effluent spray from the nozzle after cutting through the web.

5. The moveable integral water jet web cutting and trim chute assembly of claim 1 wherein the trim chute opening is bounded by a first side edge extending in the first direction of web travel substantially in alignment with the cutting aperture to limit that portion of the web passing over the trim chute opening; and further including negative pressure means associated with the trim chute for drawing the strip into and through the trim chute.

6. The moveable integral water jet web cutting and trim chute assembly of claim 1 wherein the first support plate has a plurality of suction apertures positioned substantially on an inboard side of the cutting aperture defined relative to the web to support the web after the strip has been cut and to permit the strip to be directed into the trim chute opening.

7. The moveable integral water jet web cutting and trim assembly of claim 6 wherein the suction apertures are positioned both upstream and downstream of the cutting aperture in the first direction of web travel.

8. The moveable integral water jet web cutting and trim chute assembly of claim 7 wherein the first support plate further includes depending side walls extending away from the web and a rear wall closing the side walls to define a chamber, the water jet nozzle located in the chamber and second negative pressure means being applied to the chamber.

9. The moveable integral water jet web cutting and trim chute assembly of claim 1 wherein the trim chute is located on the same side of the web as the first support plate, the trim chute having an opening in the first support plate downstream of the cutting aperture and a lead-in curved surface immediately downstream of the cutting aperture extending from the first support plate and into the trim chute opening overwhich the strip passes.

10. The moveable integral water jet web cutting and trim chute assembly of claim 1 wherein the negative pressure means includes a flexible hose connected to the trim chute to maintain the negative pressure in the trim chute and to move with lateral movement of the trim chute relative to the web.

11. The moveable integral water jet web cutting and trim chute assembly of claim 1 wherein the negative pressure means includes a stationary extension chute having an opening coupled with the trim chute permitting relative lateral movement between the trim chute and the stationary extension chute while maintaining the negative pressure to the trim chute from the stationary extension chute.

* * * * *